US007079931B2

(12) United States Patent
Sahm et al.

(10) Patent No.: US 7,079,931 B2
(45) Date of Patent: Jul. 18, 2006

(54) POSITIONING SYSTEM FOR AN EXCAVATING WORK MACHINE

(75) Inventors: William Charles Sahm, Dunlap, IL (US); Craig Lawrence Koehrsen, ChristChurch (NZ)

(73) Assignee: Caterpillar Inc., Peoria, IL (US)

( * ) Notice: Subject to any disclaimer, the term of this patent is extended or adjusted under 35 U.S.C. 154(b) by 183 days.

(21) Appl. No.: 10/731,250

(22) Filed: Dec. 10, 2003

(65) Prior Publication Data

US 2005/0131610 A1 Jun. 16, 2005

(51) Int. Cl.
*G06F 19/00* (2006.01)

(52) U.S. Cl. ..... 701/50; 37/414; 414/699

(58) Field of Classification Search ..... 701/50; 37/414; 414/699
See application file for complete search history.

(56) References Cited

U.S. PATENT DOCUMENTS 4,491,927 A 1/1985 Bachmann et al.
4,775,940 A 10/1988 Nishida et al.
4,805,086 A 2/1989 Nielsen et al.
4,807,131 A 2/1989 Clegg
4,829,418 A 5/1989 Nielsen et al.
4,866,641 A 9/1989 Nielsen et al.
4,888,890 A 12/1989 Studebaker et al.
4,945,221 A 7/1990 Nielsen et al.
5,188,502 A * 2/1993 Tonsor et al. ..... 414/700
5,375,663 A 12/1994 Teach
5,424,623 A * 6/1995 Allen et al. ..... 318/568.18
5,438,771 A 8/1995 Sahm et al.
5,446,980 A 9/1995 Rocke
5,461,803 A 10/1995 Rocke
5,471,391 A 11/1995 Gudat et al.
5,493,494 A 2/1996 Henderson
5,493,798 A 2/1996 Rocke et al.
5,550,757 A 8/1996 Tervahauta
5,587,929 A 12/1996 League et al.
5,600,436 A 2/1997 Gudat
5,610,574 A 3/1997 Mutoh et al.
5,612,864 A 3/1997 Henderson
5,631,658 A 5/1997 Gudat et al.
5,646,844 A 7/1997 Gudat et al.
5,682,311 A 10/1997 Clark
5,682,312 A 10/1997 Rocke
5,735,352 A 4/1998 Henderson et al.
5,764,511 A 6/1998 Henderson
5,801,967 A 9/1998 Henderson et al.
5,815,826 A 9/1998 Henderson
5,850,341 A 12/1998 Fournier et al.
5,854,988 A 12/1998 Davidson et al.

(Continued)

*Primary Examiner*—Yonel Beaulieu
(74) *Attorney, Agent, or Firm*—Finnegan, Henderson, Farabow, Garrett LLP

(57) ABSTRACT

A system and method for determining a position of a work tool of a work machine is provided. A desired surface configuration for a geographic location is identified. A mode of operation for the work machine is selected from one of a first mode and a second mode depending on surface configurations. The position of a work tool mounted on the work machine is sensed and the rotational angle of a swing assembly mounting the work tool is sensed. The location of the work tool is determined relative to the surface configuration based on the sensed position of the work tool when the work machine is operating in the first mode. The location of the work tool is determined relative to the desired surface configuration based on the sensed position of the work tool and the sensed rotational angle of the swing assembly when operating in the second mode.

22 Claims, 5 Drawing Sheets

U.S. PATENT DOCUMENTS

| | | | | |
|---|---|---|---|---|
| 5,864,060 | A | 1/1999 | Henderson et al. | |
| 5,912,512 | A | 6/1999 | Hayashi et al. | |
| 5,925,085 | A | 7/1999 | Kleimenhagen et al. | |
| 5,933,346 | A | 8/1999 | Brabec et al. | |
| 5,935,192 | A | 8/1999 | Henderson et al. | |
| 5,944,764 | A | 8/1999 | Henderson et al. | |
| 5,969,633 | A | 10/1999 | Röosler | |
| 6,047,227 | A | 4/2000 | Henderson et al. | |
| 6,061,617 | A | 5/2000 | Berger et al. | |
| 6,073,068 | A | 6/2000 | Koehrsen | |
| 6,076,029 | A | 6/2000 | Watanabe et al. | |
| 6,085,583 | A | 7/2000 | Cannon et al. | |
| 6,112,143 | A | 8/2000 | Allen et al. | |
| 6,144,113 | A | 11/2000 | Hayashi et al. | |
| 6,152,238 | A | 11/2000 | Ferrell et al. | |
| 6,263,595 | B1 | 7/2001 | Ake | |
| 6,282,477 | B1 | 8/2001 | Gudat et al. | |
| 6,336,077 | B1 | 1/2002 | Boucher | |
| 6,364,028 | B1 | 4/2002 | Ferrell et al. | |
| 2005/0046599 | A1* | 3/2005 | Sahm et al. | 340/995.1 |

* cited by examiner

POSITIONING SYSTEM FOR AN EXCAVATING WORK MACHINE

TECHNICAL FIELD

The present invention is directed to a positioning system for a work machine and, more particularly, to a positioning system for an excavating work machine.

BACKGROUND

Work machines are commonly used to excavate earth or other material from a geographic location in a work site. These work machines typically include a work implement linkage that supports a ground engaging tool, such as, for example, a bucket or shovel. A work machine operator may control the movement of the work implement linkage and the ground engaging tool to excavate earth or other material from the geographic location to shape the surface to conform to a desired surface configuration.

The work implements of these work machines are commonly powered by a hydraulic system. A typical hydraulic system includes a series of hydraulic actuators, which may be, for example, hydraulic cylinders, that are interconnected with the work implement linkage. The hydraulic system may also include a series of control valves that govern the rate and direction of fluid flow into and out of each hydraulic actuator. By coordinating the fluid flow to and from each hydraulic actuator, the overall motion of the work implement linkage and the ground engaging tool may be controlled.

An operator may control the work implement linkage on the work machine to excavate earth from a geographic location to achieve the desired surface configuration, which may be, for example, a surface having a certain slope or a trench having a certain length, width, and depth. In many cases, a substantial amount of earth, or other material, must be excavated to achieve the desired surface configuration. A number of measurements of the location of the current elevation of the surface of the geographic location may be required to determine when the proper amount of material has been excavated to achieve the desired surface configuration.

The work machine may include a positioning system to assist the operator in achieving the desired surface configuration. For example, as shown in U.S. Pat. No. 6,336,077 to Boucher, the work implement linkage of a work machine may be equipped with sensors that allow the position of the ground engaging tool to be determined. The work machine may also include a computer control that allows the operator to input a desired hole depth and an associated slope gradient leading to the hole. The computer control may further provide a display having a representation of the desired hole depth and the associated slope gradient.

However, this type of positioning system may only provide an estimate as to the location of the ground engaging tool relative to the desired hole depth or slope gradient. The system described in the '077 patent does not account for a rotation of the work implement linkage, such as when the operator activates a swing assembly on the work machine. If the rotational angle of the work implement linkage is varied and this variation is not taken into account during the positional computation, the positioning system may not correctly determine the position of the ground engaging tool relative to the desired hole depth or slope gradient.

The system and method described below solves one or more of the problems set forth above.

SUMMARY OF THE INVENTION

One aspect of the present disclosure is directed to a method of determining a position of a ground engaging tool of a work machine. A desired surface configuration for a geographic location is identified. A mode of operation for the work machine is selected from one of a first operating mode when the desired surface configuration has a first type of surface configuration and a second operating mode when the desired surface configuration has a second type of surface configuration. A position of a ground engaging tool mounted on the work machine is sensed. A rotational angle of a swing assembly mounting the ground engaging tool is sensed. The location of the ground engaging tool is determined relative to the desired surface configuration based on the sensed position of the ground engaging tool, independently of the rotational angle of the swing assembly, when the work machine is operating in the first operating mode. The location of the ground engaging tool is determined relative to the desired surface configuration based on the sensed position of the ground engaging tool and the sensed rotational angle of the swing assembly when the work machine is operating in the second operating mode.

Another aspect of the present disclosure is directed to a positioning system for a work machine having a ground engaging tool and a rotatable swing assembly that mounts the ground engaging tool. An input device allows an operator to select an operating mode from one of a first operating mode and a second operating mode and allows the operator to enter a desired surface configuration for a geographic location. A position sensing system is operatively connected to the swing assembly and to he ground engaging tool. The position sensing system provides an indication of a position of the ground engaging tool and an indication of a rotational angle of the swing assembly. A control determines the location of the ground engaging tool relative to the desired surface configuration based on the sensed position of the ground engaging tool, independently of the rotational angle of the swing assembly, when the first operating mode is selected. The control further determines the location of the ground engaging tool relative to the desired surface configuration based on the sensed position of the ground engaging tool and the sensed rotational angle of the swing assembly when the second operating mode is selected.

DETAILED DESCRIPTION

Figure 1:
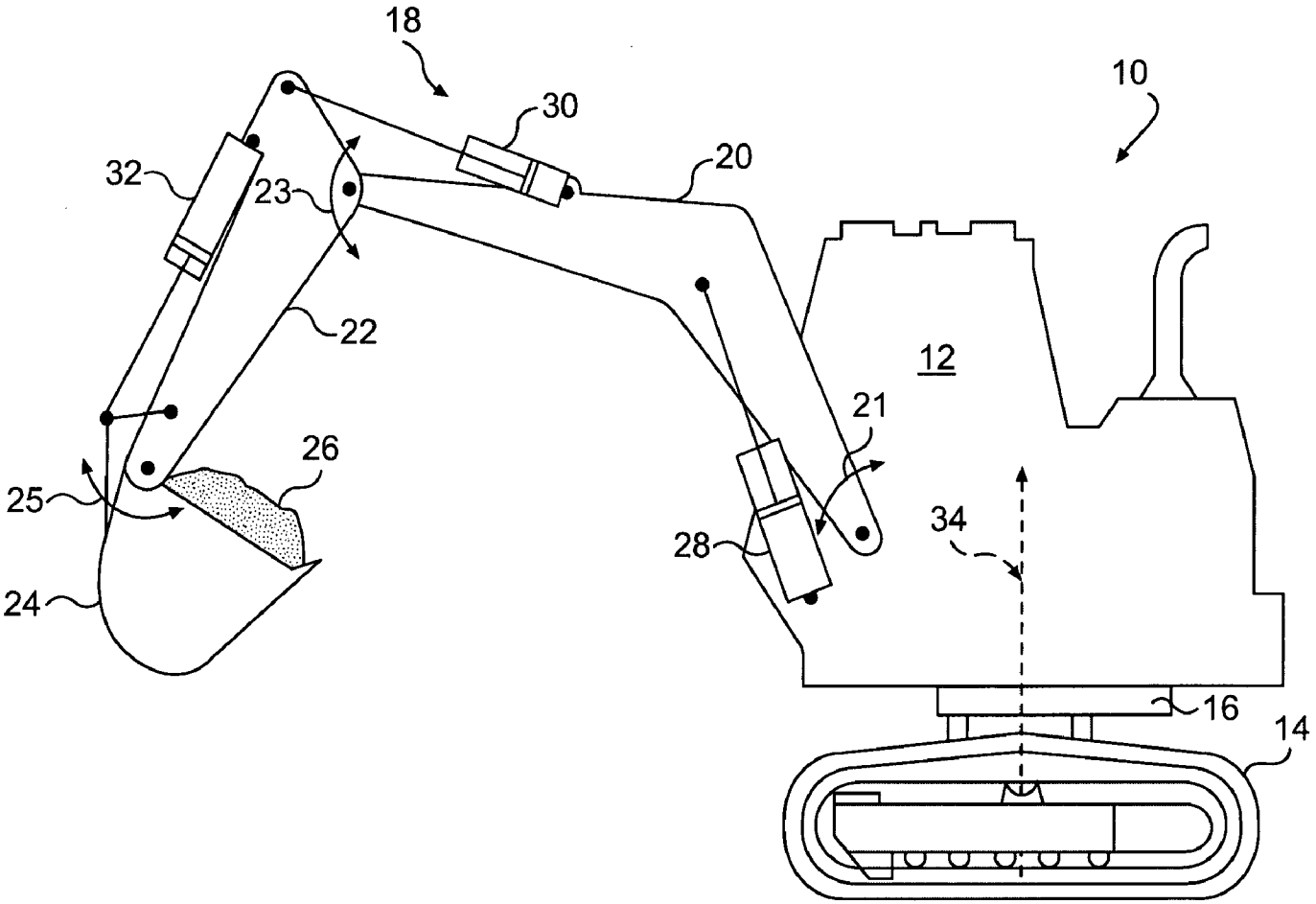
FIG. 1 is a side pictorial view of an exemplary work machine in accordance with the present invention.

An exemplary embodiment of a work machine 10 is illustrated in FIG. 1. Work machine 10 may be any type of machine commonly used to excavate earth, or other material, from a geographic location, such as, for example, an excavator or a backhoe. For the purposes of the present disclosure, the term "geographic location" is intended to include any land feature or terrain that may be excavated to shape the surface of the terrain to conform to a desired surface configuration. For example, work machine 10 may be used to excavate material from a construction site or mining site.

As illustrated in FIG. 1, work machine 10 includes a housing 12 that may include a seating area for an operator. Housing 12 may be mounted on a swing assembly 16 that is configured to rotate or pivot housing 12 about a vertical axis 34. Swing assembly 16 may include a hydraulic actuator, such as, for example, a fluid motor or a hydraulic cylinder, that pivots housing 12 about vertical axis 34. Pressurized fluid may be introduced to the hydraulic actuator of swing assembly 16 to move swing assembly 16. The direction and rate of the introduced flow of pressurized fluid governs the direction and velocity of movement of swing assembly 16.

Housing 12 and swing assembly 16 are supported by a traction device 14. Traction device 14 may be any type of device that is capable of providing a stable support for work machine 10 when work machine 10 is in operation. In addition, traction device 14 may provide for movement of work machine 10 around a job site and/or between job sites. For example, traction device 14 may be a wheel base or a track base. In addition, traction device may be a water-based vessel such as, for example, a barge.

As further illustrated in FIG. 1, work machine 10 includes a work implement linkage 18 that operatively mounts a ground engaging tool 24. Work implement linkage 18 may include a boom 20 that operatively mounts a stick 22. Stick 22 may operatively mount ground engaging tool 24. Ground engaging tool 24 may be any type of mechanism commonly used on a work machine to move a load 26 of earth, debris, or other material. For example, ground engaging tool 24 may be a shovel, a bucket, a blade, or a clamshell.

Boom 20 may be pivotally mounted on housing 12 for movement in the directions indicated by arrow 21. In another exemplary embodiment, boom 20 may be mounted directly on swing assembly 16 and housing 12 may be fixed relative to traction device 14. In this alternative embodiment, swing assembly 16 would allow boom to pivot about a vertical axis relative to housing 12.

A boom actuator 28 may be connected between boom 20 and housing 12 or between boom 20 and swing assembly 16. Boom actuator 28 may be one or more hydraulically powered actuators, such as, for example, fluid motors or hydraulic cylinders. Alternatively, boom actuator 28 may be any other device readily apparent to one skilled in the art as capable of moving boom 20 relative to housing 12. Pressurized fluid may be introduced to boom actuator 28 to move boom 20 relative to housing 12. The direction and rate of the pressurized fluid flow to boom actuator 28 may be controlled to thereby control the direction and speed of movement of boom 20.

Stick 22 is pivotally connected to one end of boom 20 for movement in the directions indicated by arrow 23. A stick actuator 30 may be connected between stick 22 and boom 20. Stick actuator 30 may be one or more hydraulically powered actuators, such as, for example, fluid motors or hydraulic cylinders. Alternatively, stick actuator 22 may be any other device readily apparent to one skilled in the art as capable of moving stick 22 relative to boom 20. Pressurized fluid may be introduced to stick actuator 30 to move stick 22 relative to boom 20. The direction and rate of the pressurized fluid flow to stick actuator 30 may be controlled to thereby control the direction and speed of movement of stick 22.

Ground engaging tool 24 is pivotally connected to one end of stick 22 for movement in the directions indicated by arrow 25. A tool actuator 32 may be connected between ground engaging tool 24 and stick 22. Tool actuator 32 may be one or more hydraulically powered actuators, such as, for example, fluid motors or hydraulic cylinders. Alternatively, tool actuator 32 may be any other appropriate device readily apparent to one skilled in the art as capable of moving ground engaging tool 24 relative to stick 22. Pressurized fluid may be introduced to tool actuator 32 to move ground engaging tool 24 relative to stick 22. The direction and rate of the pressurized fluid flow to tool actuator 32 may be controlled to thereby control the direction and speed of movement of ground engaging tool 24 relative to stick 22.

Figure 2:
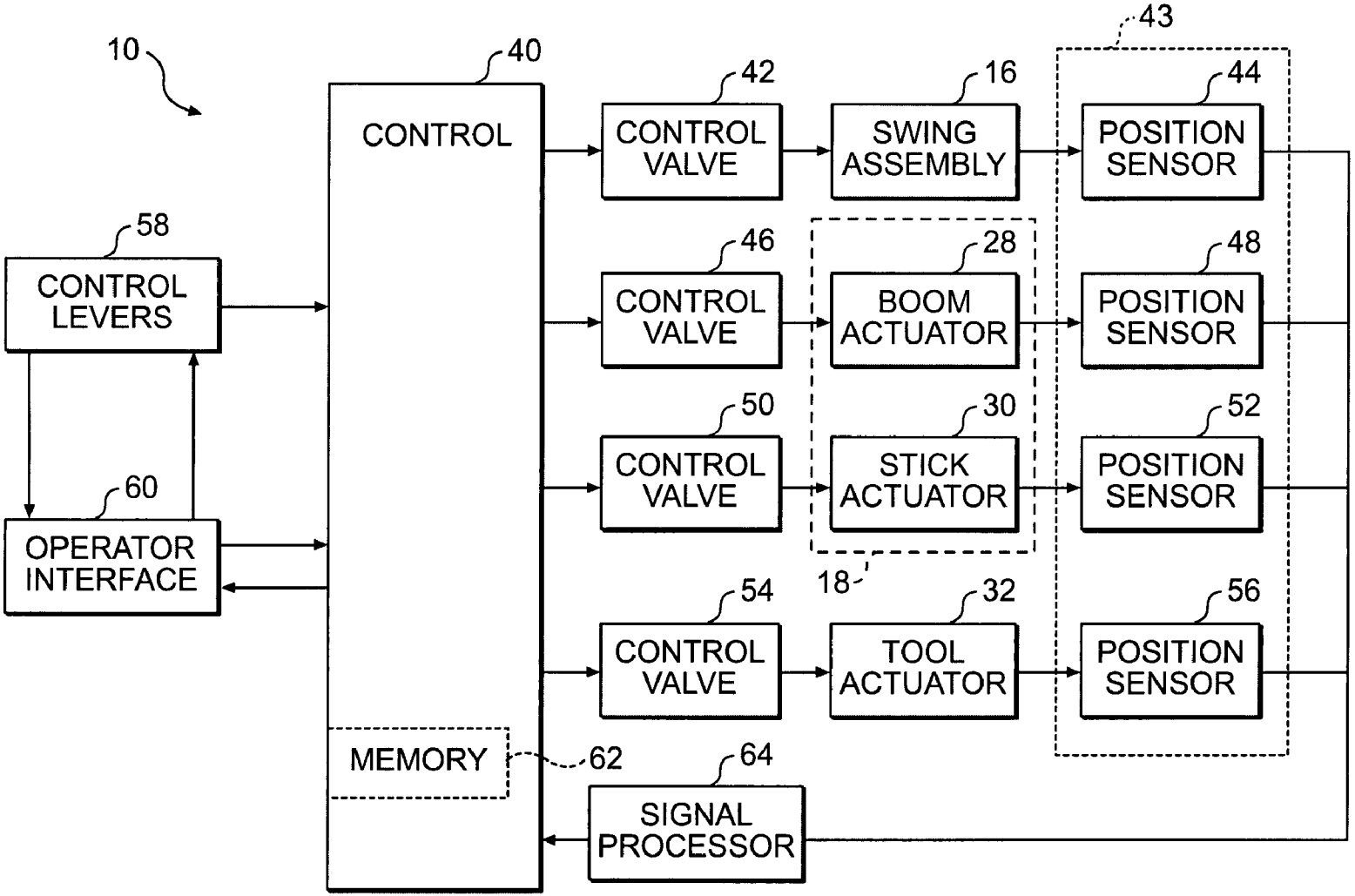
FIG. 2 is a block diagram of an exemplary embodiment of a work machine in accordance with an exemplary embodiment of the present invention.

As diagrammatically illustrated in FIG. 2, work machine 10 may include a control 40. Control 40 may include a computer, which has all the components required to run an application, such as, for example, a memory 62, a secondary storage device, a processor, such as a central processing unit, and an input device. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

As further illustrated in FIG. 2, control 40 is operatively connected to a series of control valves 42, 46, 50, and 54. Control valve 42 is disposed in a fluid line leading to swing assembly 16. Control valve 46 is disposed in a fluid line leading to boom actuator 28. Control valve 50 is disposed in a fluid line leading to stick actuator 30. Control valve 54 is disposed in a fluid line leading to tool actuator 32.

Each control valve 42, 46, 50, and 54 is configured to control the rate and direction of fluid flow to the chambers of a hydraulic actuator. For example, control valve 42 controls the rate and direction of the fluid flow to the hydraulic actuator of swing assembly 16. Similarly, control valves 46, 50, and 54 control the rate and direction of fluid flow to boom actuator 28, stick actuator 30, and tool actuator 32, respectively. Each control valve 42, 46, 50, and 54 may be, for example, a directional control valve such as a set of four independent metering valves. Alternatively, each control valve 42, 46, 50 and 54 may be a spool valve, a split-spool valve, or any other mechanism configured to control the rate and direction of a fluid flow into and out of a hydraulic actuator.

Control 40 is configured to control the relative positions of control valves 42, 46, 50, and 54 to thereby control the rate and direction of fluid flow to the respective hydraulic actuators. By controlling the rate and direction of fluid flow through control valves 42, 46, 50, and 54, control 40 may control the rate and direction of movement of swing assembly 16, boom 20, stick 22, and ground engaging tool 24. In this manner, control 40 may control the overall rate and direction of movement of work implement linkage 18.

As illustrated in FIG. 2, work machine 10 may also include a position sensing system 43 that provides information on the position of work implement linkage 18 and ground engaging tool 24. Position sensing system 43 may include a series sensors 44, 48, 52, and 56 that are adapted to sense the position of work implement linkage 18 and ground engaging tool 24. The series of sensors may be any type of sensor commonly used to determine the relative positions of the elements of a mechanical linkage.

In one exemplary embodiment, position sensors 44, 48, 52, and 56 may be adapted to determine the relative positions of each element in work implement linkage 18 supporting ground engaging tool 24. In particular, position sensor 44 may be adapted to measure the angle of rotation of swing assembly 16 relative to vertical axis 34; position sensor 48 may be adapted to measure the angle between housing 12 and boom 20; position sensor 52 may be adapted to measure the angle of rotation between boom 20 and stick 22; and position sensor 54 may be adapted to measure the angle of rotation between stick 22 and ground engaging tool 24. From this information, control 40 may determine the location of ground engaging tool 24 relative to housing 12.

Alternatively, position sensors 44, 48, 52, and 56 may be adapted to determine the relative displacement of the respective actuator, i.e. to determine the distance that the actuator is extended. In particular, position sensor 44 may be adapted to measure the extension of the hydraulic actuator associated with swing assembly 16; position sensor 48 may be adapted to measure the extension of boom actuator 28; position sensor 52 may be adapted to measure the extension of stick actuator 30; and position sensor 54 may be adapted to measure the extension of tool actuator 32. From this information, control 40 may also determine the location of ground engaging tool 24 relative to housing 12.

As will be apparent to one skilled in the art, by knowing the displacement of the actuators, the position of boom 20, stick 22, and ground engaging tool 24 relative to housing 12 may be determined through straightforward trigonometric calculations. Position sensing system 43 transmits this positional information to control 40. A signal processor 64 may be included to condition the position signals. Thus, position sensing system 43 provides the information required for control 40 to calculate the current position of ground engaging tool 24. Control 40 may use the positional information to determine the velocity, direction, and acceleration rate of ground engaging tool 24.

Control 40 may receive movement instructions from an operator and/or an automated control program. For example, an operator may manipulate an input device consisting of a set of control levers 58 to provide the movement instructions. The set of control levers 58 may include, for example, one lever to control the motion of each of swing assembly 16, boom 20, stick 22, and ground engaging tool 24. By selectively moving the set of control levers 58, an operator may individually and selectively control the rate and direction of movement of each of swing assembly 16, boom 20, stick 22, and ground engaging tool 24. Thus, by coordinating movement of control levers 58, the operator may control motion of work implement linkage 18. In addition, control 40 may include an automated program that provides movement instructions for work implement linkage 18 and ground engaging tool 24 to guide ground engaging tool 24 throughout an entire work cycle.

Work machine 10 may also include an operator interface 60. Operator interface 60 may provide an interface between an operator and control 40. Operator interface 60 may allow the operator to input information to control 40 and may display information from control 40 to the operator.

Operator interface 60 may include an input device, such as, for example, a touch screen, a keyboard, a mouse, or a joystick. An operator may input information through the input device related to a particular job. This information may include, for example, a desired surface configuration for a particular geographic location.

Figure 3B:
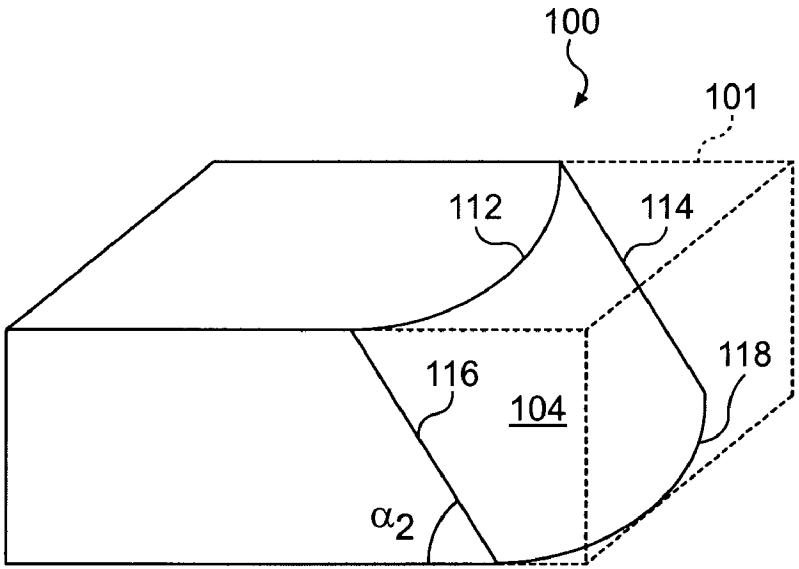
FIG. 3*b* is a pictorial representation of an exemplary embodiment of a surface configuration having a partially conical shape.
Figure 3A:
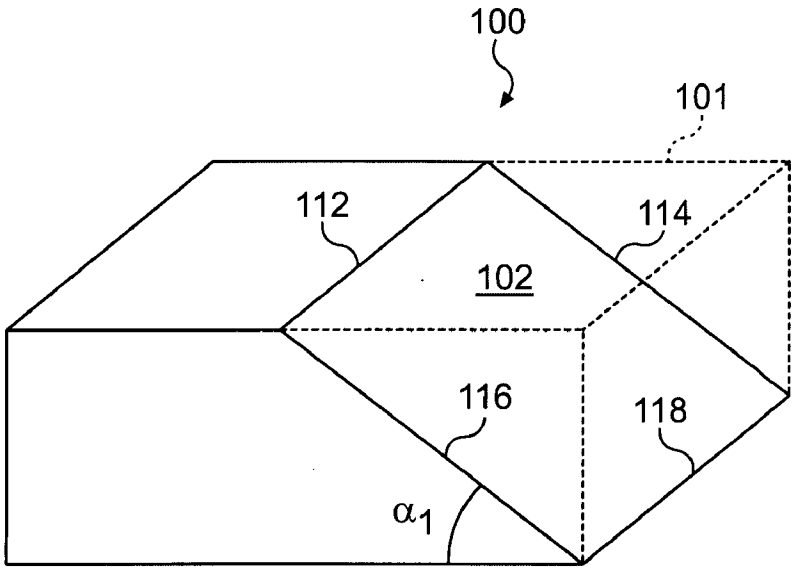
FIG. 3*a* is a pictorial representation of an exemplary embodiment of a surface configuration having a plane shape.

For example, based on work requirements for a particular geographic location, the operator may identify certain configuration parameters for a desired surface configuration. As shown in FIGS. 3*a* and 3*b*, the operator may desire to excavate a current ground level 101 of a geographic location 100 to a desired surface configuration. In FIG. 3*a*, the desired surface configuration is a surface plane 102 that has the shape of a substantially flat plane that is disposed at an angle, $\alpha_1$. In FIG. 3*b*, the desired surface configuration is a curved surface 104 having an arcuate profile, which may result in a partially conical shape, that is disposed at an angle, $\alpha_2$.

Operator interface 60 may allow the operator to select an operating mode depending upon the desired surface configuration to be formed in the particular geographic location. For example, the operator may select a "plane mode" when the desired surface configuration is similar to surface plane 102 as illustrated in FIG. 3*a*. Alternatively, the operator may select a "curved mode" when the desired surface configuration is similar to the curved surface 104 illustrated in FIG. 3*b*.

Operator interface 60 may further allow the operator to enter additional positional parameters relevant to the desired surface configuration. For example, the operator may enter the relevant angles, $\alpha_1$ and $\alpha_2$. In addition, the operator may enter other relevant information, such as, for example, the length and location of one or more of a series of borders 112, 114, 116, and 118 that define the edges of the desired surface configuration.

Operator interface 60 may also allow the operator to set a reference angle for use during the "plane mode" of operation. The reference angle may represent a particular angle of swing assembly 16 relative to work machine 10 or relative to work surface 102. The reference angle may be used by control 40 to determine the positioning of the planar surface relative to work machine 10.

Figure 4:
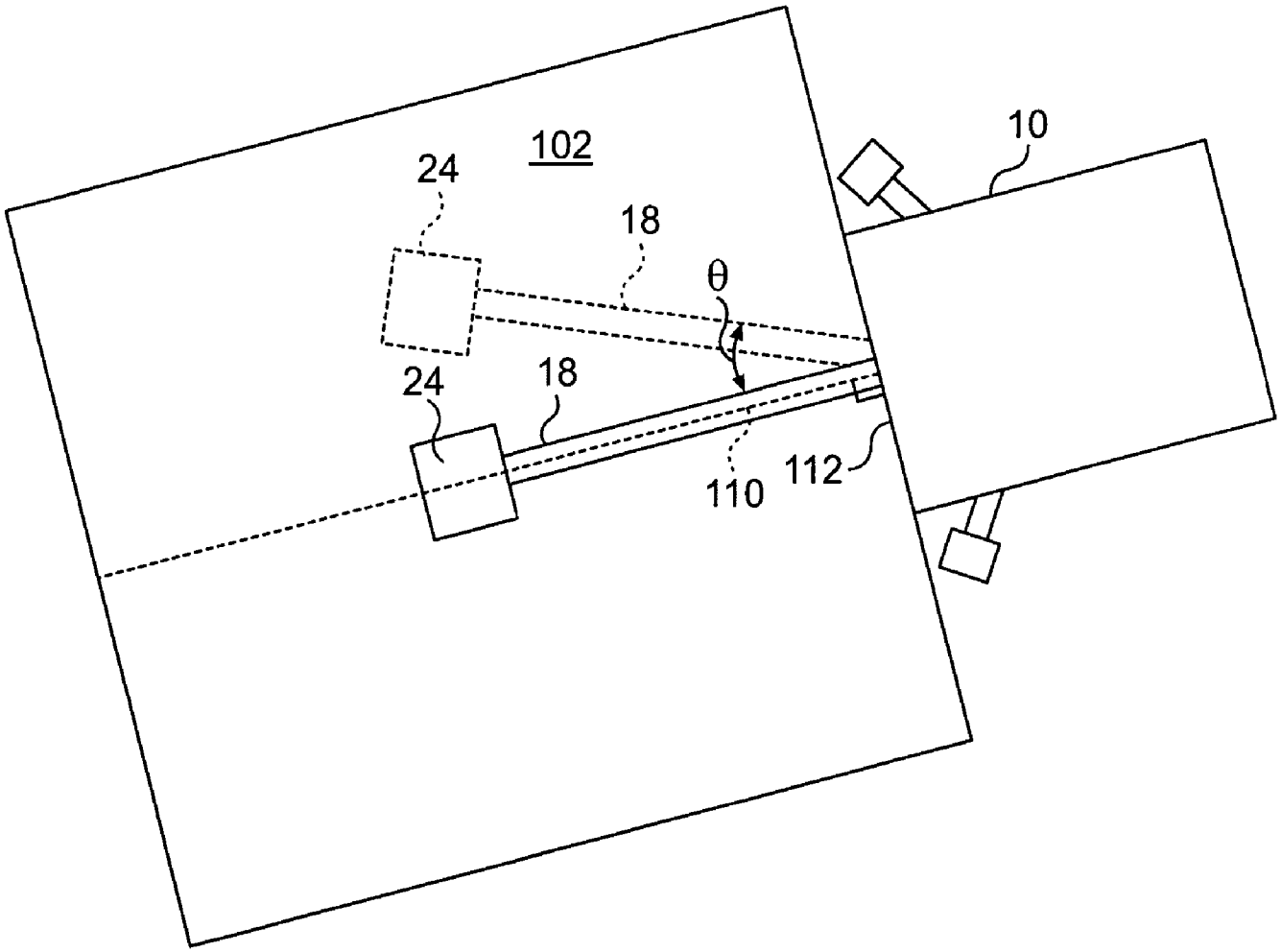
FIG. 4 is a top diagrammatic view of a work machine positioned adjacent the surface configuration of FIG. 3*a*.

The reference angle may be set by rotating swing assembly 16 to move work implement linkage 18 into a certain spatial relationship with respect to the location of the desired surface plane 102. For example, as shown in FIG. 4, the reference angle may be set when work implement linkage 18 is positioned to extend along a line 110 that is substantially perpendicular to border 112 of the desired surface plane 102. Alternatively, reference angle may be set when work implement linkage 18 is disposed substantially parallel to one of borders 114, 116, or in any other spatial relationship with desired surface plane 102 that is apparent to one skilled in the art.

When the operator provides an indication to control 40 that work implement linkage 18 is properly positioned with respect to the desired surface plane 102, control 40 may read the rotational angle of swing assembly from position sensor 44 and store the angle in memory 62. Control 40 may use the stored reference angle to determine the location of the desired surface configuration when operating in the "plane mode."

Operator interface 60 may also provide the operator with a display illustrating the relative position of ground engaging tool 24 and the desired surface configuration. Based on the input parameters provided by the operator, control 40 may generate and display a profile of the desired surface configuration. Control 40 may also determine the current position of ground engaging tool 24 from position sensing system 43 and display a representation of ground engaging tool 24 relative to the profile of the desired surface configuration.

Figure 5:
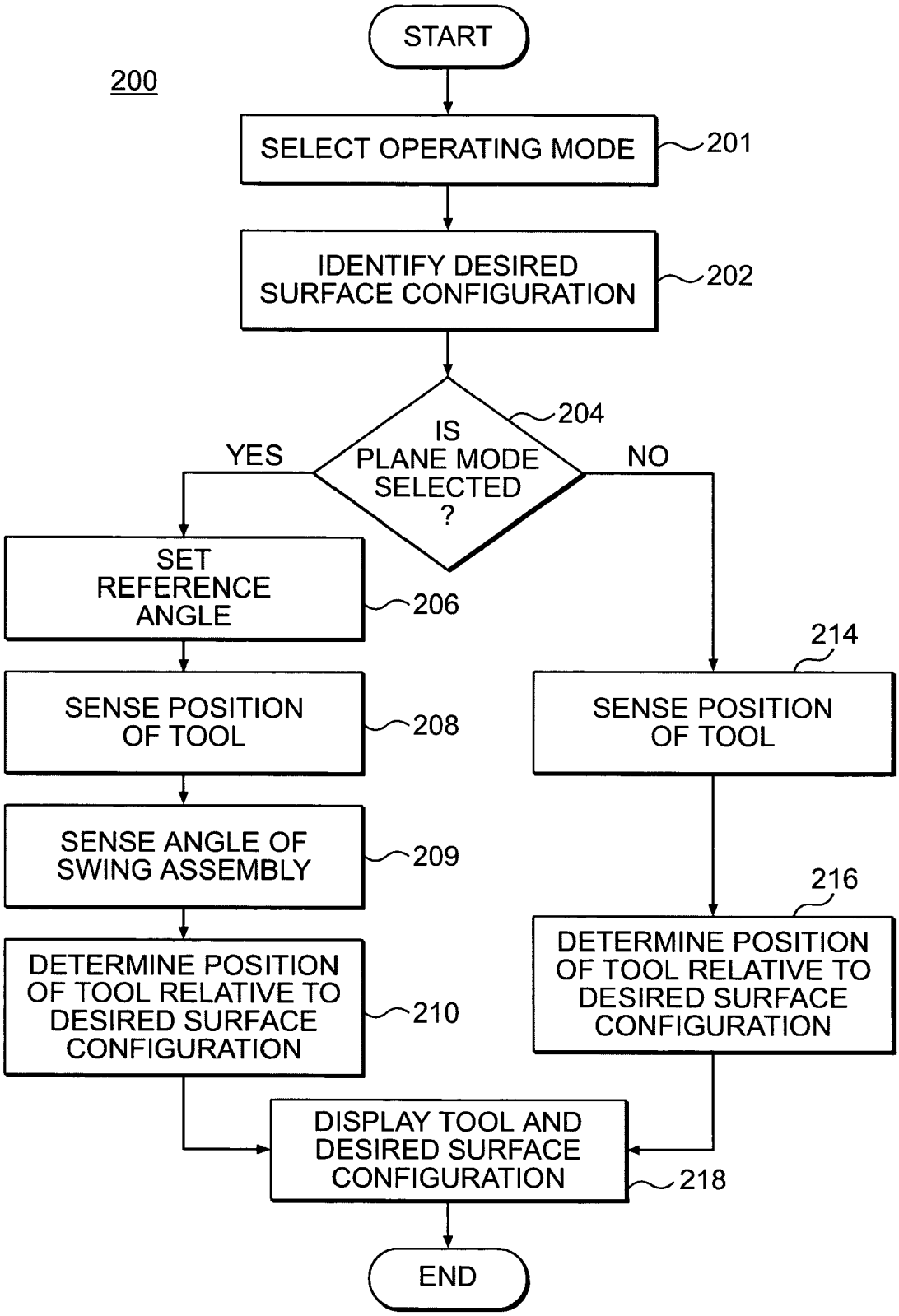
FIG. 5 is a flowchart illustrating an exemplary positional determination method for an excavating work machine.

As described in greater detail below, the process used by control 40 to determine the position of ground engaging tool 24 relative to the desired surface configuration may depend upon the operating mode selected by the operator. An exemplary method 200 of determining the position of ground engaging tool 24 relative to the desired surface configuration is illustrated in FIG. 5.

INDUSTRIAL APPLICABILITY

An operator may position work machine 10 at a particular geographic location at which excavation is desired. The operator may select an operating mode for work machine 10 based upon the desired surface configuration to be excavated at the particular geographic location. (Step 201). In one embodiment, the operator may select between a "plane mode" and a "curved mode." The "plane mode" may be selected when the desired surface configuration has a substantially planar shape. The "curved mode" may be selected when the desired surface configuration has a arcuate shape or a partially conical shape.

The operator may also identify a desired surface configuration for the particular geographic location through operator interface 60. (Step 202) The desired surface configuration may be expressed as a slope angle or a slope percentage. The desired surface configuration may further be expressed as distance parameters that identify one or more borders 112, 114, 116, 118 of the desired surface configuration.

Control 40 may also determine which operating mode has been selected by the operator. (Step 204). If the operator has selected the "plane mode" of operation, control 40 may prompt the operator to set a reference angle. (Step 206). The operator may set the reference angle by rotating swing assembly 16 to place work implement linkage 18 in a certain spatial relationship to the desired surface plane. For example, as shown in FIG. 4, the operator may rotate work implement linkage to extend along a line 110 that is substantially perpendicular to border 112 of desired surface plane 102.

When work implement linkage 18 is properly positioned, the operator indicates to control 40, such as by depressing a button, that the reference angle should be set. Upon receipt of the indication, control 40 determines the current rotational angle of swing assembly 16 and stores the current rotational angle as the reference angle. Once the reference angle is established, the operator may start removing material from the geographic location.

As the operator moves the work implement linkage 18 and/or the swing assembly 16, control 40 may monitor the position of ground engaging tool 24 relative to work machine 10 or relative to work surface 102. The position of ground engaging tool 24 may be determined based on information provided by position sensing system 43. In particular, the position of ground engaging tool 24 may be sensed by position sensors 48, 52, and 56. (Step 208). In addition, the rotational angle of swing assembly 16 relative to the reference angle may be sensed by position sensor 44. (Step 209). An exemplary measurement of a rotational angle of swing assembly 16 relative to the reference angle is indicated as θ in FIG. 4.

Control 40 may determine the position of ground engaging tool 24 relative to the desired surface configuration. (Step 210). When operating in the "plane mode," control 40 may perform a geometric and/or trigonometric calculation that includes the rotational angle (θ) of swing assembly 16 to determine the relative positions of ground engaging tool 24 and the desired surface configuration. The rotational angle (θ) of swing assembly 16 is relevant as the distance between work machine 10 and border 112 of desired surface plane 102 will change as swing assembly 16 is rotated. For example, as the rotational angle (θ) of swing assembly 16 is increased, the distance between work machine 10 and border 112 will also increase. Accordingly, work implement linkage 18 should extend further from work machine 18 to excavate material to achieve the desired surface configuration.

If control 40 determines that the "curved mode" has been selected, control 40 may sense the position of ground engaging tool 24 relative to work machine 10. (Step 214). Control 40 may further determine the position of ground engaging tool 24 relative to the desired surface configuration. (Step 216) In the "curved mode" of operation, the position of ground engaging tool 24 relative to the desired surface configuration may be determined without setting a reference angle. (Step 216). In the "curved mode" of operation, the distance between work machine and the arcuately shaped border 112 may be constant. Accordingly, the positional calculation may be based on the positional information provided by position sensors 48, 52, and 56. In other words, when operating in the "curved mode" control 40 may determine the position of ground engaging tool 24 relative to the desired surface configuration independently of the rotational angle of swing assembly 16.

Once the position of ground engaging tool 24 relative to the desired surface configuration has been determined in either the "plane mode" or the "curved mode," control 40 may provide a display illustrating the current position of ground engaging tool 24 relative to the desired surface configuration. (Step 218). The display may, for example, provide a side view that illustrates the height of ground engaging tool 24 relative to the desired surface configuration. Control 40 may update this display as the operator moves ground engaging tool 24 to excavate material. Control 40 may also provide an indication to the operator, such as a warning beep, when ground engaging tool 24 moves below the desired surface configuration.

In this manner, the positioning system described above may be used to provide positional information to the operator of an excavating work machine. The described system and method allows the operator to select from various modes of operation based upon the desired surface configuration to be excavated at a particular geographic location. The system acquires the information required to determine the position of the ground engaging tool relative to the desired surface configuration from an associated position sensing system. The operator may also be provided with a display that illustrates the relative positions of the ground engaging tool and the desired surface configuration.

It will be apparent to those skilled in the art that various modifications and variations can be made in the described positioning system and method without departing from the scope of the invention. Other embodiments of the disclosed positioning system and method will be apparent to those skilled in the art from consideration of the specification and practice of the system and method disclosed herein. It is intended that the specification and examples be considered as exemplary only, with a true scope being indicated by the following claims and their equivalents.

What is claimed is:

1. A method of determining a position of a ground engaging tool of a work machine, comprising:

identifying a desired surface configuration for a geographic location;

selecting a mode of operation for the work machine from one of a first operating mode when the desired surface configuration has a first type of surface configuration and a second operating mode when the desired surface configuration has a second type of surface configuration;

sensing the position of the ground engaging tool mounted on the work machine;

sensing a rotational angle of a swing assembly mounting the ground engaging tool;

determining the location of the ground engaging tool relative to the desired surface configuration based on the sensed position of the ground engaging tool, independently of the rotational angle of the swing assembly, when the work machine is operating in the first operating mode; and determining the location of the ground engaging tool relative to the desired surface configuration based on the sensed position of the ground engaging tool and the sensed rotational angle of the swing assembly when the work machine is operating in the second operating mode.

2. The method of claim 1, further including displaying a representation of the location of the ground engaging tool relative to the desired surface configuration.

3. The method of claim 1, wherein the desired surface configuration is expressed as a desired slope angle.

4. The method of claim 3, wherein the second operating mode is a plane mode and the second type of surface configuration has a substantially planar surface having the desired slope angle.

5. The method of claim 4, further including establishing a reference angle for the swing assembly, wherein the reference angle is indicative of a line extending substantially perpendicular to a border of the desired surface plane.

6. The method of claim 3, wherein the first mode of operation is a curved mode and the first type of surface configuration has an arcuate shape having the desired slope angle.

7. The method of claim 1, further including automatically moving the ground engaging tool to remove material from the geographic location to obtain the desired surface configuration.

8. A positioning system for a work machine having a ground engaging tool and a rotatable swing assembly mounting the ground engaging tool, comprising:

an input device configured to allow an operator to select an operating mode from one of a first operating mode and a second operating mode and to allow the operator to enter a desired surface configuration for a geographic location;

a position sensing system operatively connected to the swing assembly and the ground engaging tool, the position sensing system is configured to provide an indication of a position of the ground engaging tool and an indication of a rotational angle of the swing assembly; and a control operable to determine the location of the ground engaging tool relative to the desired surface configuration based on the sensed position of the ground engaging tool, independently of the rotational angle of the swing assembly, when the first operating mode is selected, the control further operable to determine the location of the ground engaging tool relative to the desired surface configuration based on the sensed position of the ground engaging tool and the sensed rotational angle of the swing assembly when the second operating mode is selected.

9. The system of claim 8, further including a display device configured to provide a display having a representation of the location of the ground engaging tool relative to the desired surface configuration.

10. The system of claim 8, wherein the ground engaging tool is mounted on a work implement linkage and the position sensing system includes a series of displacement sensors operatively connected to the work implement linkage.

11. The system of claim 8, wherein the second operating mode is a plane mode and the input device is configured to allow an operator to enter a desired slope angle for a desired surface plane to be excavated from the geographic location and to allow the operator to set a reference angle for the swing assembly when the second operating mode is selected.

12. The system of claim 11, wherein the reference angle of the swing assembly is indicative of a line extending substantially perpendicular to a border of the desired surface plane.

13. A method of determining a position of a ground engaging tool of a work machine, comprising:

identifying a desired surface configuration for a particular geographic location, wherein the desired surface configuration is a desired plane surface having a predetermined slope angle;

adjusting the position of a swing assembly to rotate a work implement linkage relative to the desired location of the desired plane surface;

setting a reference angle for the swing assembly;

moving a ground engaging tool mounted on the work implement linkage to excavate material from the geographic location;

sensing the position of the ground engaging tool mounted on the work implement linkage;

sensing a rotational angle of the swing assembly relative to the reference angle; and determining the location of the ground engaging tool relative to the desired plane surface based on the sensed position of the ground engaging tool and the sensed rotational angle of the swing assembly.

14. The method of claim 13, wherein the reference angle for the swing assembly is set when the work implement linkage extends along a line that is substantially perpendicular to a border of the desired plane surface.

15. The method of claim 13, further including:

changing an operating mode of the work machine to a curved mode where the location of the ground engaging tool relative to the desired surface is determined based on the sensed position of the ground engaging tool, independently of the rotational angle of the swing assembly.

16. The method of claim 13, further including displaying a representation of the position of the ground engaging tool relative to the desired surface configuration.

17. The method of claim 13, further including automatically moving the work implement linkage and the ground engaging tool to remove material to obtain the desired surface configuration.

18. A positioning system for a work machine having a ground engaging tool mounted on a work implement linkage and a swing assembly rotatably mounting the work implement linkage, comprising:

a control mechanism configured to control the movement of the work implement linkage and the swing assembly to thereby control the movement of the ground engaging tool;

a position sensing system operatively connected to the work implement linkage and to the swing assembly, the position sensing system configured to provide an indication of a position of the ground engaging tool and an indication of a rotational angle of the swing assembly;

an input device configured to allow an operator to enter a desired slope angle for a desired surface plane to be excavated from a geographic location, the input device further configured to allow an operator to establish a reference angle for the swing assembly; and a control operable to determine the location of the ground engaging tool relative to the desired surface plane based on the sensed position of the ground engaging tool and the sensed rotational angle of the swing assembly.

19. The system of claim 18, further including a display device configured to provide a display having a representation of the location of the ground engaging tool relative to the desired surface plane.

20. The system of claim 18, wherein the position sensing system includes a series of sensors operatively connected to the work implement linkage.

21. The system of claim 18, wherein the input device is further configured to allow the operator to change an operating mode of the work machine to a curved mode where the control determines the location of the ground engaging tool relative to the desired surface based on the sensed position of the ground engaging tool, independently of the rotational angle of the swing assembly.

22. The system of claim 18, wherein the reference angle is indicative of a line extending substantially perpendicularly to a border of the desired surface plane.

* * * * *